US006768404B2

(12) United States Patent
Ojeda et al.

(10) Patent No.: US 6,768,404 B2
(45) Date of Patent: Jul. 27, 2004

(54) CIRCUIT BREAKER AND PLUNGER ASSEMBLY SUPPORT STRUCTURE INCLUDING A POSITIONING MEMBER

(75) Inventors: Ramon J. Ojeda, Findlay, PA (US); Yu Wei Chou, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/213,549

(22) Filed: Aug. 6, 2002

(65) Prior Publication Data

US 2004/0027219 A1 Feb. 12, 2004

(51) Int. Cl.[7] ..... H01H 9/00

(52) U.S. Cl. ..... 335/175; 335/249; 335/262; 335/270

(58) Field of Search ..... 335/14, 166–176, 335/220–224, 249, 251–5, 262, 270

(56) References Cited

U.S. PATENT DOCUMENTS 3,360,751 A * 12/1967 Gauthier et al. ..... 335/175
4,503,408 A 3/1985 Mrenna et al.
4,801,907 A * 1/1989 Kelaita et al. ..... 335/20
5,894,257 A * 4/1999 Roger et al. ..... 335/172
5,927,484 A 7/1999 Malingowski et al.
6,366,187 B1 4/2002 Malingowski et al.

* cited by examiner

*Primary Examiner*—Lincoln Donovan
(74) *Attorney, Agent, or Firm*—M. J. Moran

(57) ABSTRACT

A circuit breaker includes a housing, separable contacts disposed in the housing, a latchable operating mechanism structured to separate the separable contacts, and a magnetic trip mechanism coupled to the latchable operating mechanism. The magnetic trip mechanism includes a plunger assembly support structure and a plunger assembly having a moveable core. The plunger assembly support structure includes a wall having a slot therein. The moveable core rests in the slot. A positioning member has a hook and an opening. The hook engages the wall of the plunger assembly support structure. The moveable core passes through the opening of the positioning member, which retains the moveable core relative to the plunger assembly support structure.

10 Claims, 5 Drawing Sheets

CIRCUIT BREAKER AND PLUNGER ASSEMBLY SUPPORT STRUCTURE INCLUDING A POSITIONING MEMBER

BACKGROUND OF THE INVENTION

1. Field of the Invention

The invention relates to a magnetic trip device for a circuit breaker and, more particularly, to a support structure for a moveable core of the magnetic trip device. The invention also relates to a circuit breaker including a magnetic trip device and a support structure for a moveable core of the magnetic trip device.

2. Background Information

Molded case circuit breakers are well known in the art. Examples are disclosed in U.S. Pat. Nos. 4,503,408; 5,927,484; and 6,366,187, which are incorporated by reference herein.

Molded case circuit breakers typically include separable contacts, an operating mechanism, and a trip unit, which are mounted inside of a molded plastic insulative housing.

A common type of magnetic trip device for a trip unit is a solenoid, which includes a stationary core through which passes the current in the protected circuit. This current creates a magnetic field. When there are very high instantaneous currents, such as those associated with a short circuit, the magnetic field intensifies. The magnetic trip device may include a plunger assembly having a moveable core and a plunger tab, which engages a trip latch on the operating mechanism. The plunger assembly is partially disposed within the stationary core. Typically, a spring provides a limited force biasing the moveable core away from the stationary core and preventing the plunger from engaging the trip latch. When a short circuit occurs, the current in the stationary core creates a magnetic field strong enough to overcome the moveable core spring, thereby allowing the moveable core to move toward the stationary core and causing the plunger to engage the trip latch.

Adjusting the amount of separation between the plunger assembly and stationary core may control the amount of current required to trip the circuit breaker. When the plunger assembly is located closer to the stationary core, a weaker magnetic field, and therefore a lower current, is required to draw the plunger assembly toward the stationary core. In order to adjust the trip condition, the plunger assembly is mounted in a plunger assembly support structure having a base and a moveable plunger carriage. The carriage allows the plunger assembly, including the moveable core, to be moved relative to the stationary core. A carriage is employed, in order that adjusting the gap between the moveable core and the stationary core does not impact on the compression of the moveable core biasing spring. The moveable plunger carriage is coupled to an adjustment mechanism to address the initial gap between the plunger assembly and the stationary core.

U.S. Pat. No. 6,366,187 discloses a plunger assembly support structure, which maintains the orientation of a plunger carriage in the circuit breaker housing, maintains the moveable core alignment with the stationery core, and corrects rotation of the plunger tab on the moveable core. During operation of the trip mechanism, it is possible for the moveable core to rotate axially, thereby allowing the plunger tab to move out of alignment with the actuating arm of the trip bar. The plunger tab contacts a plunger guide. As the plunger carriage travels from a first position towards a second position, the plunger tab contacts a conical indentation and rotates the moveable core, in order that the plunger tab is aligned with the trip bar actuating arm.

The moveable core of U.S. Pat. No. 6,366,187 rests in a slot of the plunger carriage. It is known to employ a conventional flat washer having an opening about the moveable core and positioned between the plunger carriage slot and a plunger assembly spring. In the event of an overcurrent condition, the moveable core may move within the slot and, hence, the position of the moveable core in the plunger carriage may change. This causes the plunger tab to hit random locations of the trip bar actuating arm. As a result, the trip current level is inconsistent.

Accordingly, there is room for improvement in circuit breakers and magnetic trip devices having a moveable core support structure.

SUMMARY OF THE INVENTION

These needs and others are met by the present invention, which provides a positioning member having a hook and an opening. The hook engages the wall of a plunger assembly support structure. A moveable core passes through the opening of the positioning member, which retains the moveable core relative to the plunger assembly support structure.

As one aspect of the invention, a circuit breaker comprises: a housing; at least one pair of separable contacts disposed in the housing; a latchable operating mechanism structured to separate the at least one pair of separable contacts; a magnetic trip mechanism coupled to the latchable operating mechanism, the magnetic trip mechanism including a plunger assembly support structure and a plunger assembly having a moveable core, the plunger assembly support structure including a wall having a slot therein, the moveable core resting in the slot; and a positioning member having a hook and an opening, the hook engaging the wall of the plunger assembly support structure, the moveable core passing through the opening of the positioning member, which retains the moveable core relative to the plunger assembly support structure.

The plunger assembly support structure may include a plunger carriage assembly having a member, which engages the hook of the positioning member.

The positioning member may position the moveable core at a fixed distance from the plunger assembly support structure.

As another aspect of the invention, a plunger assembly support structure for a plunger assembly of a magnetic trip mechanism comprises: a base including a wall having a slot therein; a plunger assembly having a moveable core resting in the slot; and a positioning member having a hook and an opening, the hook engaging the wall of the base, the moveable core passing through the opening of the positioning member, which retains the moveable core relative to the base.

As another aspect of the invention, a positioning member comprises: a washer portion having an opening; and a hook portion disposed from the washer portion.

The hook portion may be a J-shaped hook portion.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
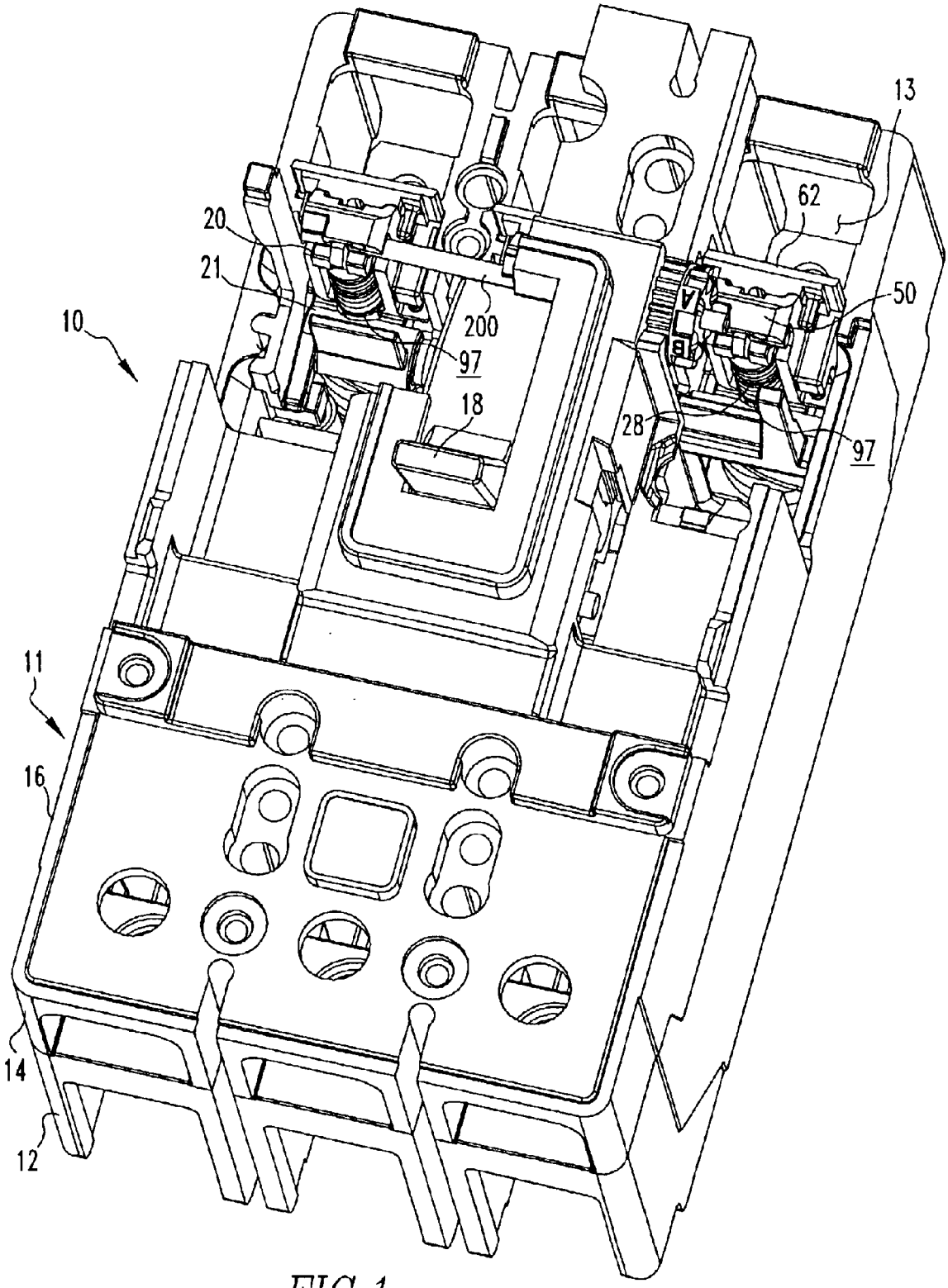
FIG. 1 is a partial cut away view of a circuit breaker housing incorporating a positioning washer for a moveable core in accordance with the present invention.

FIG. 1 shows a molded case circuit breaker 10 according to a preferred embodiment of the present invention. The circuit breaker 10 has a housing 11 including a base portion 12, which is coupled to a primary cover 14. The base portion 12 includes a plurality of cavities 13, which support the various circuit breaker components. Disposed on top of the primary cover 14 is a secondary cover 16. An operating handle 18 protrudes through the secondary cover 16.

Figure 3:
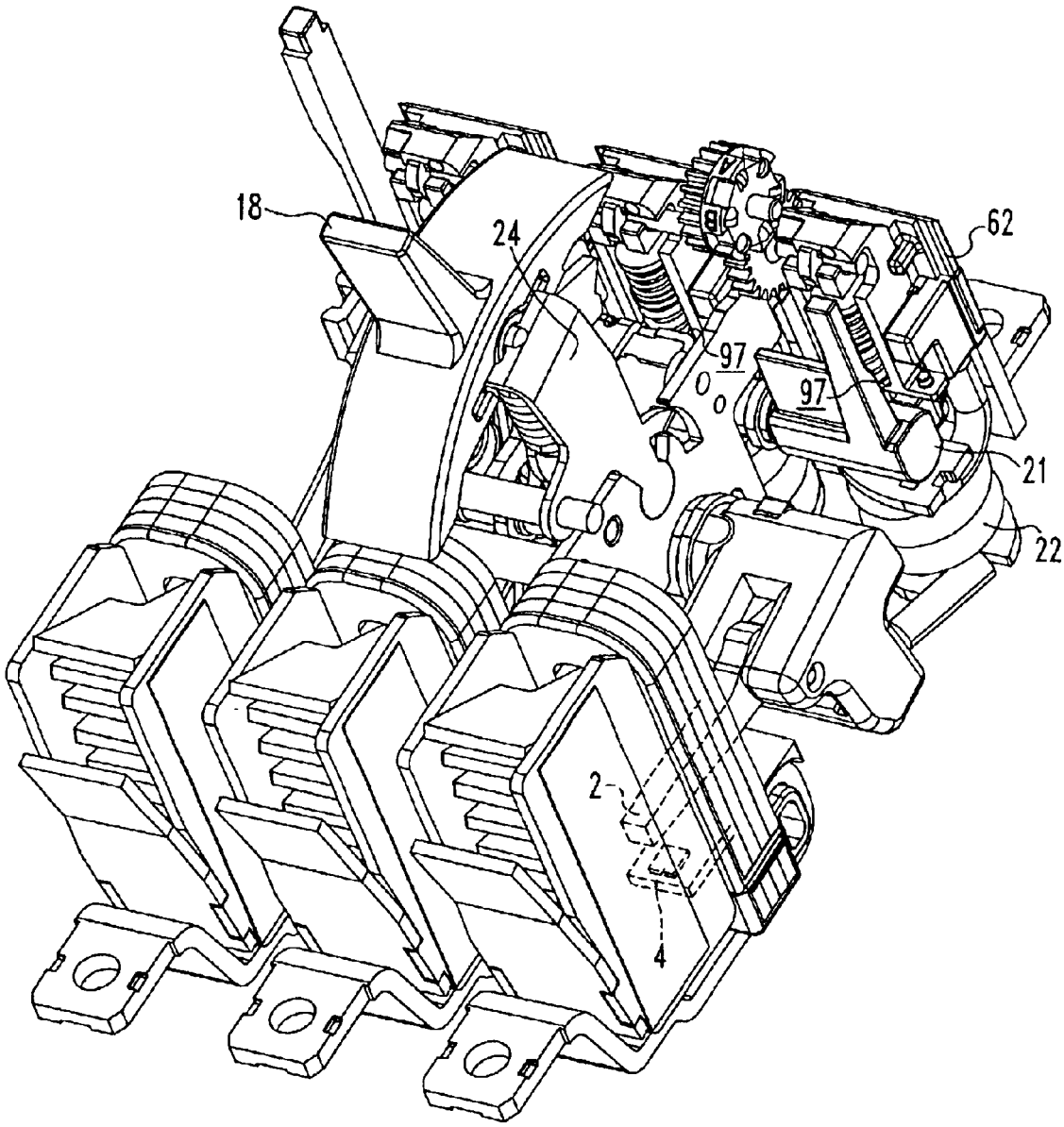
FIG. 3 is an isometric view of a circuit breaker mechanism without the circuit breaker housing of FIG. 1.

At least one pair of main contacts 2,4 (as shown in FIG. 3) is disposed within housing 11. The contacts include a moveable contact 2 and a stationary contact 4. The moveable contact 2 is coupled to and is in electrical communication with the load side of the circuit breaker 10. The stationary contact 4 is coupled to and is in electrical communication with an electrical line (not shown). The operating handle 18 is coupled to the moveable contact 2 within the circuit breaker housing 11 and may be used to reset the circuit breaker 10 after it has been tripped or to manually open or close the circuit breaker.

Figure 2:
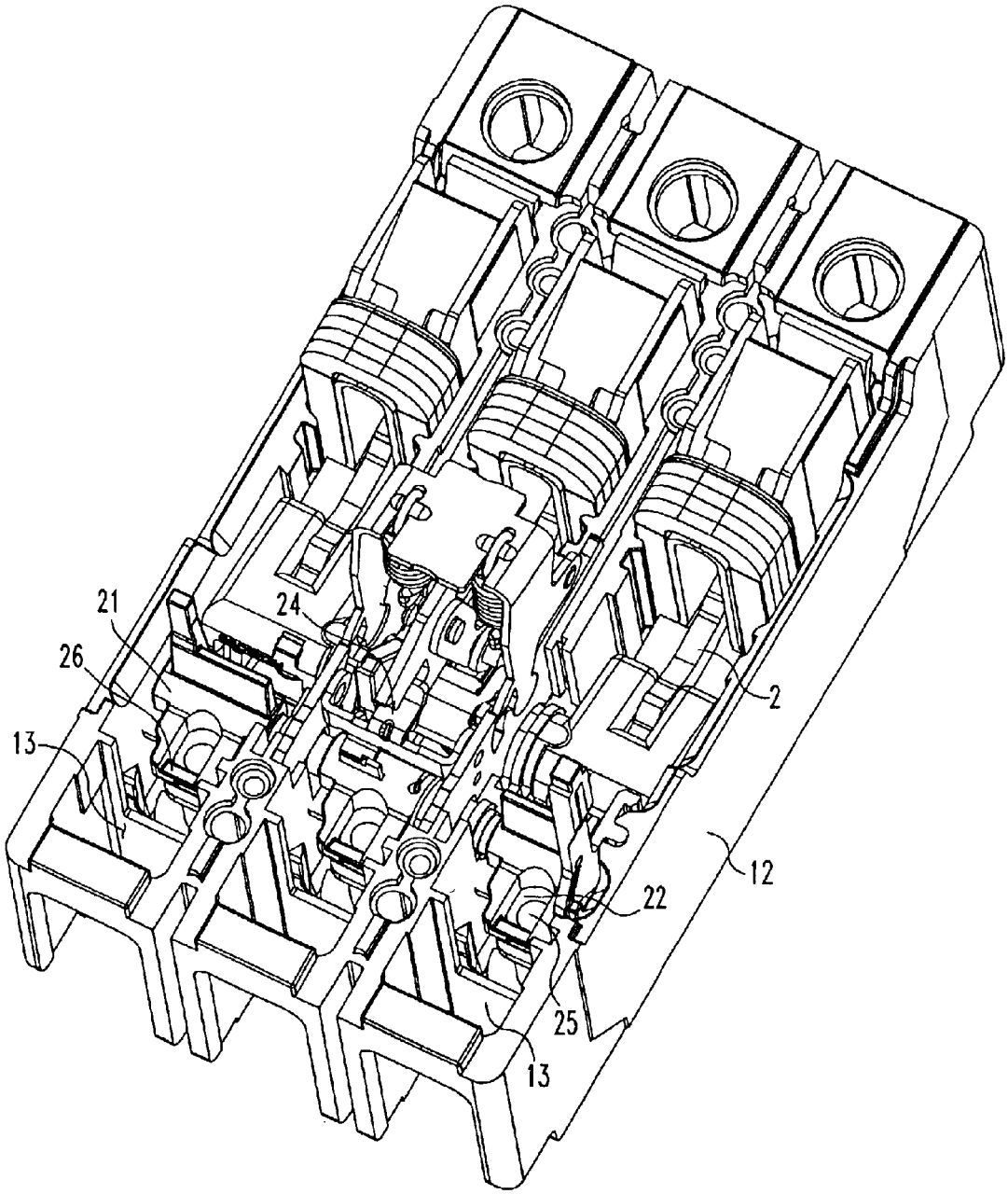
FIG. 2 PRIOR ART
FIG. 2 is an isometric view of a circuit breaker with top covers and plunger carriages removed.

Referring to FIGS. 1–3, a separate magnetic trip assembly 20 may trip the circuit breaker 10. The magnetic trip assembly 20 cooperates with a rotating trip bar 21, which is coupled to a latchable operating mechanism 24. As is well known, rotation of the trip bar 21 releases the latchable operating mechanism 24 allowing the circuit breaker 10 to trip. The trip bar 21 includes at least one actuating arm 26, which is adjacent to the magnetic trip assembly 20.

Figure 5:
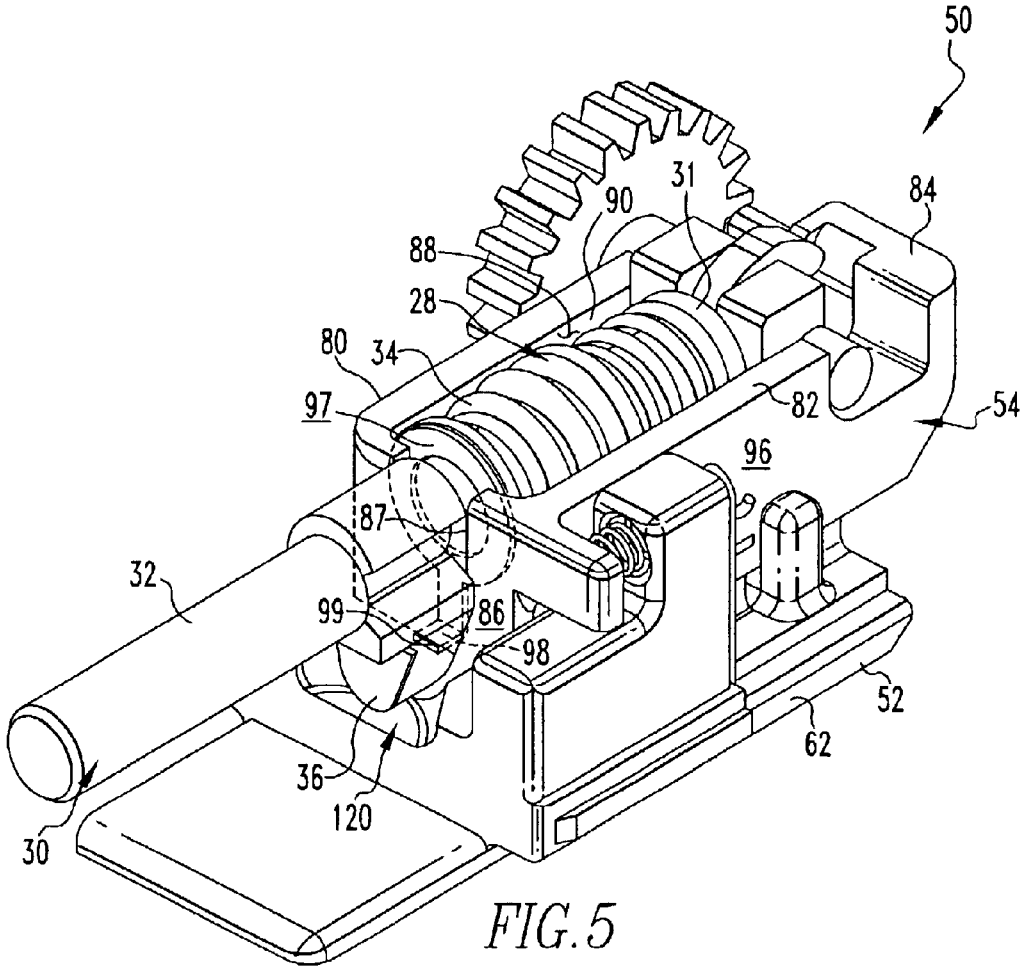
FIG. 5 is an isometric view of a single positioning washer and plunger carriage support structure in accordance with the present invention.

Referring to FIGS. 2 and 5, the magnetic trip assembly 20 (FIG. 1) includes a stationary core 22, a plunger assembly 28, and a plunger assembly support structure 50. The stationary core 22 is disposed within one of the cavities 13 in the bottom housing 12 and forms a portion of the load circuit through the circuit breaker 10. The stationary core 22 is preferably shaped as a coil. The stationary core 22 includes a medial aperture 25, preferably having a circular cross-section. The stationary core 22 is disposed between the moveable main contact 2 and the load side of the breaker 10. When current flows through the stationary core 22, a magnetic field generating a magnetic force is created.

As shown in FIG. 5, the plunger assembly 28 includes a moveable core 30 having a flattened end 31, a cylindrical portion 32, a coil spring 34 and a plunger tab 36. The moveable core 30 is preferably a solid metal cylinder. The coil spring 34 is disposed about moveable core 30. The plunger assembly 28 is disposed within a cavity 88 of the plunger assembly support structure 50.

The moveable core 30 rests in a slot 87 of the plunger carriage assembly 54. During assembly and in the event of an over-current condition, the moveable core 30 may move out of the slot 87 (and out of the cavity 88) and, hence, without the exemplary positioning washer 97, the position of the moveable core 30 in the slot 87 of the plunger carriage assembly 54 would change. This would, otherwise, cause the plunger tab 36 to hit random locations of the actuating arm 26 of the trip bar 21 (FIG. 2).

Figure 6:
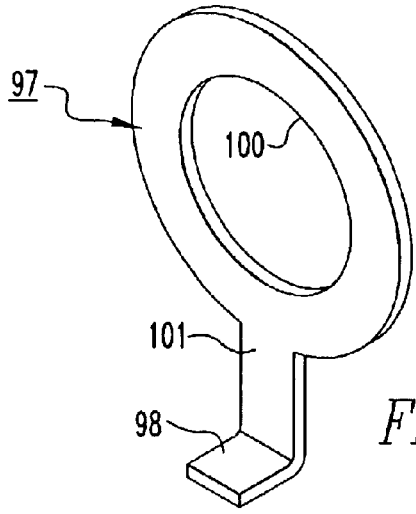
FIG. 6 is an isometric view of the positioning washer of FIGS. 4 and 5.

As best shown in FIG. 5, the positioning washer 97 is part of the moveable core 30 and is positioned between one end of the coil spring 34 and the plunger tab 36. The exemplary positioning washer 97 acts as a spacer (e.g., to further compress the spring 34 and increase the spring force and, therefore, to change the trip threshold) and, also, includes a hook 98 (as best shown in FIG. 6), which retains the location of the moveable core 30 in the slot 87 relative to the plunger guide 120 and the plunger carriage assembly 54. The exemplary J-shaped hook 98 on the positioning washer 97 is disposed from a washer portion 101 and latches to the edge 99 of the bottom member 86 of the plunger carriage assembly 54. The moveable core 30 passes through the opening 100 of the positioning washer 97. This prevents the moveable core 30 from shifting from its intended location in the slot 87 relative to the plunger guide 120 and the plunger carriage assembly 54. One end of coil spring 34 contacts the flattened end 31, while the other end of this spring contacts the positioning washer 97.

The plunger assembly support structure 50 includes a base member assembly 52 and the plunger carriage assembly 54. The plunger assembly 28 is disposed within the plunger carriage assembly 54, which is slidably disposed adjacent to the base member assembly 52. The plunger carriage assembly 54 is slidable, in order that the distance between the moveable core 30 and the stationary core 22 (FIGS. 2 and 3), and, therefore, the trip condition of the circuit breaker 10, may be selectively adjusted. Except for the positioning washer 97 and hook 98, the plunger assembly support structure 50, base member assembly 52, plunger carriage assembly 54 and plunger assembly 28 are disclosed in incorporated by reference U.S. Pat. No. 6,366,187.

Figure 4:
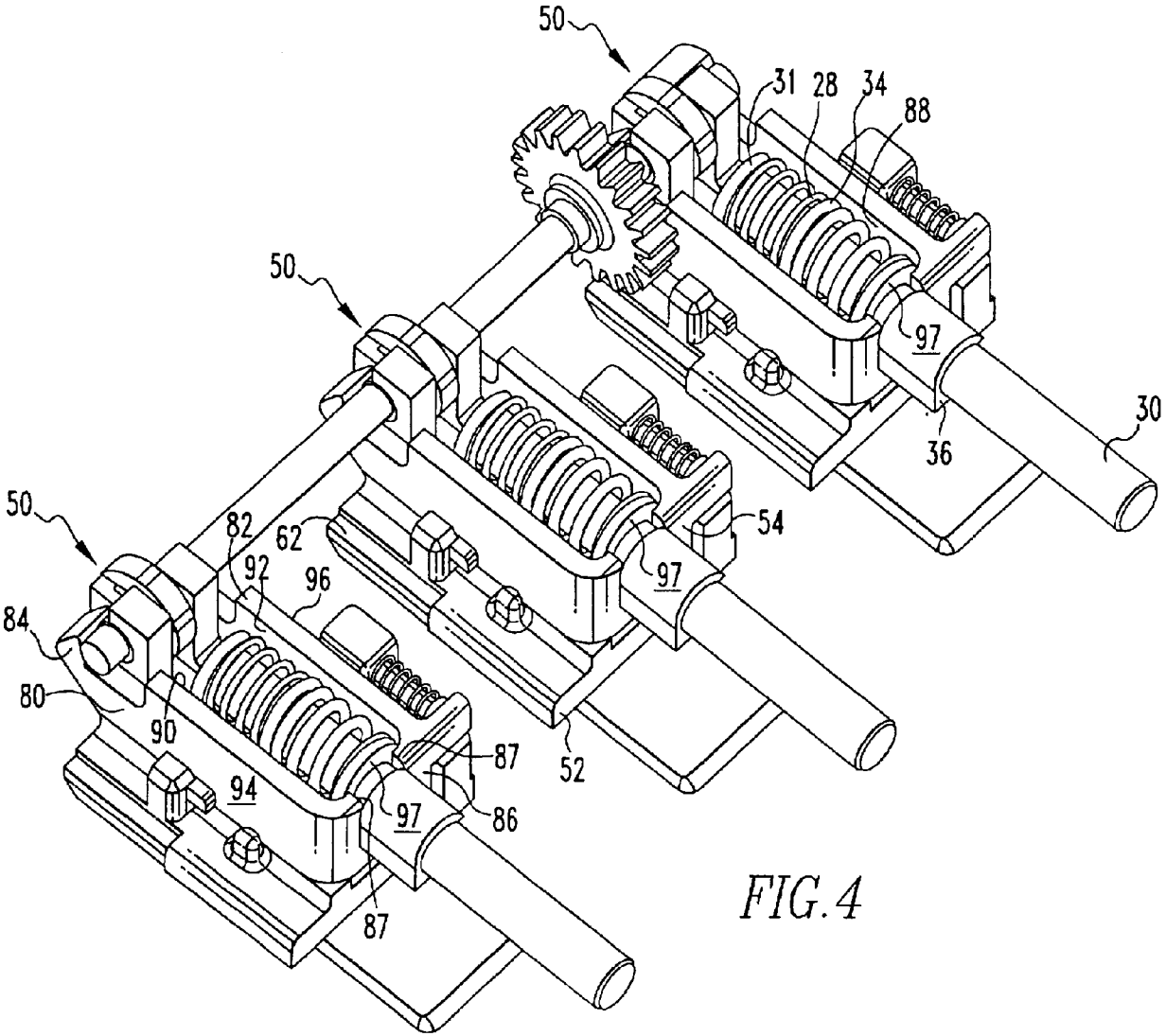
FIG. 4 is an isometric view of a plurality of positioning washers and plunger carriage support structures in accordance with the present invention.

As shown in FIG. 5, the housing body 62 preferably includes the plunger guide 120, which, during movement of the plunger carriage assembly 54, automatically realigns the plunger tab 36 with the trip bar actuating arm 26 (FIG. 2). Also referring to FIG. 4, the plunger carriage assembly 54 includes a first side member 80 and a second side member 82. The first side member 80 and the second side member 82 are held in spaced relation by a top member 84 and a bottom member 86. An open-faced cavity 88 is formed between the first side member 80 and the second side member 82. Both the first side member 80 and the second side member 82 have interior sides 90,92 and exterior sides 94,96, respectively.

Under normal operating conditions, the coil spring 34 overcomes the magnetic force created by the electric current through the stationary core 22 (FIGS. 2 and 3) and biases the flattened end 31 of the moveable core 30 away from the plunger carriage bottom member 86 and the stationary core 22. The biasing force of the coil spring 34 also prevents the plunger tab 36 from engaging the trip bar actuating arm 26.

When an over-current condition occurs, however, the magnetic force created by the current through the stationary core 22 increases in strength. When the magnetic force becomes strong enough to overcome the bias of the coil spring 34, the plunger assembly 28 is drawn towards the stationary core 22. As the plunger assembly 28 is drawn towards the stationary core 22, the plunger tab 36 engages the trip bar actuating arm 26 causing the trip bar 21 to rotate clockwise (with respect to FIG. 3). When the trip bar 21 rotates, the latchable operating mechanism 24 is released allowing the circuit breaker 10 to trip. When the plunger assembly 28 moves, either because of an over-current condition or due to adjustment by a user, the positioning washer 97 maintains the moveable core 30 in the slot 87 relative to the plunger guide 120 and the plunger carriage assembly 54. Otherwise, without the positioning washer 97, the plunger assembly 28 may become misaligned relative to the stationary core 22 or the trip bar actuating arm 26.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing;

at least one pair of separable contacts disposed in said housing;

a latchable operating mechanism structured to separate said at least one pair of separable contacts;

a magnetic trip mechanism coupled to said latchable operating mechanism, said magnetic trip mechanism including a plunger assembly support structure and a plunger assembly having a moveable core, said plunger assembly support structure including a wall having a slot therein, said moveable core resting in said slot; and a positioning member having a hook and an opening, said hook engaging the wall of said plunger assembly support structure, said moveable core passing through the opening of said positioning member, which retains said moveable core within said slot and relative to said plunger assembly support structure.

2. A circuit breaker comprising:

a housing;

at least one pair of separable contacts disposed in said housing;

a latchable operating mechanism structured to separate said at least one pair of separable contacts;

a magnetic trip mechanism coupled to said latchable operating mechanism, said magnetic trip mechanism including a plunger assembly support structure and a plunger assembly having a moveable core, said plunger assembly support structure including a wall having a slot therein, said moveable core resting in said slot; and a positioning member having a hook and an opening, said hook engaging the wall of said plunger assembly support structure, said moveable core passing through the opening of said positioning member, which retains said moveable core relative to said plunger assembly support structure, wherein said positioning member is a positioning washer.

3. The circuit breaker of claim 1 wherein said positioning member includes a washer portion having said opening; and wherein said hook is a J-shaped hook portion disposed from said washer portion.

4. A circuit breaker comprising:

a housing;

at least one pair of separable contacts disposed in said housing;

a latchable operating mechanism structured to separate said at least one pair of separable contacts;

a magnetic trip mechanism coupled to said latchable operating mechanism, said magnetic trip mechanism including a plunger assembly support structure and a plunger assembly having a moveable core, said plunger assembly support structure including a wall having a slot therein, said moveable core resting in said slot; and a positioning member having a hook and an opening, said hook engaging the wall of said plunger assembly support structure, said moveable core passing through the opening of said positioning member, which retains said moveable core relative to said plunger assembly support structure, wherein said plunger assembly support structure further includes a plunger carriage assembly having a member, which engages the hook of said positioning member.

5. The circuit breaker of claim 1 wherein said slot has a longitudinal axis; and wherein said positioning member positions said moveable core at a fixed distance from said plunger assembly support structure along said longitudinal axis.

6. The circuit breaker of claim 1 wherein said moveable core includes a cylindrical portion, an end portion disposed on said cylindrical portion, a spring, and a tab on said cylindrical portion, said spring positioned about said cylindrical portion between the end portion and the tab.

7. A circuit breaker comprising:

a housing;

at least one pair of separable contacts disposed in said housing;

a latchable operating mechanism structured to separate said at least one pair of separable contacts;

a magnetic trip mechanism coupled to said latchable operating mechanism, said magnetic trip mechanism including a plunger assembly support structure and a plunger assembly having a moveable core, said plunger assembly support structure including a wall having a slot therein, said moveable core resting in said slot; and a positioning member having a hook and an opening, said hook engaging the wall of said plunger assembly support structure, said moveable core passing through the opening of said positioning member, which retains said moveable core relative to said plunger assembly support structure, wherein said moveable core includes a cylindrical portion, an end portion disposed on said cylindrical portion, a spring, and a tab on said cylindrical portion, said spring positioned about said cylindrical portion between the end portion and the tab, and wherein said positioning member is part of said moveable core and is positioned between the spring and the tab.

8. The circuit breaker of claim 7 wherein said spring has one end, which contacts the end portion, and another end, which contacts the positioning member.

9. The circuit breaker of claim 1 wherein said magnetic trip mechanism further includes a stationary core, which is structured for operation with said moveable core.

10. The circuit breaker of claim 1 wherein said moveable core includes a cylindrical portion having a tab; wherein said magnetic trip mechanism includes a trip bar having a trip actuator; and wherein said moveable core moves to engage the trip actuator of the trip bar with the tab of the cylindrical portion.

* * * * *